US008689473B2

(12) United States Patent
James et al.

(10) Patent No.: US 8,689,473 B2
(45) **Date of Patent: *Apr. 8, 2014**

(54) DEVICE FOR CREATING AND DISPLAYING LIQUID-MEDIUM MOVEMENT WITHIN A VESSEL CONTAINING A DIORAMIC SCENE

(71) Applicant: Rainglobes LLC, Seattle, WA (US)

(72) Inventors: Joshua James, New York, NY (US); Frederick Bowen Northup, Jr., Seattle, WA (US); Lawrence Scott Larson, Seattle, WA (US); Jeremy Kolenbrander, Brighton, CO (US); James Ladtkow, Brighton, CO (US)

(73) Assignee: RainGlobes, LLC, Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/790,470

(22) Filed: Mar. 8, 2013

(65) Prior Publication Data

US 2013/0185968 A1 Jul. 25, 2013

Related U.S. Application Data

(63) Continuation of application No. 13/296,047, filed on Nov. 14, 2011, now Pat. No. 8,393,099, which is a continuation of application No. 12/419,902, filed on Apr. 7, 2009, now Pat. No. 8,056,274.

(60) Provisional application No. 61/043,990, filed on Apr. 10, 2008.

(51) Int. Cl.

| | |
|---|---|
| ***G09F 19/00*** | (2006.01) |
| ***G09F 19/08*** | (2006.01) |
| ***E03B 9/20*** | (2006.01) |
| ***B05B 17/08*** | (2006.01) |
| ***F21S 8/00*** | (2006.01) |
| ***B05B 1/00*** | (2006.01) |
| ***B05B 1/26*** | (2006.01) |

(52) U.S. Cl.
USPC ..... 40/406; 40/409; 40/410; 40/412; 40/422; 446/153; 446/154; 446/267; 239/16; 239/17; 239/18; 239/20; 239/211; 239/548; 239/556; 239/558

(58) Field of Classification Search
USPC ..... 40/406, 409, 410, 412, 422; 446/153, 446/154, 267; 239/16, 17, 18, 20, 211, 548, 239/556, 558
See application file for complete search history.

(56) References Cited

U.S. PATENT DOCUMENTS

| | | | | |
|---|---|---|---|---|
| 3,842,531 | A | 10/1974 | Sloan | |
| 5,291,674 | A | 3/1994 | Torrence | |
| 5,442,869 | A | 8/1995 | McDarren et al. | |
| 6,165,036 | A | 12/2000 | Hino et al. | |
| 6,270,420 | B1 * | 8/2001 | Lee | 472/67 |
| 6,449,887 | B1 * | 9/2002 | Song | 40/406 |
| 6,499,854 | B2 * | 12/2002 | Chen | 362/101 |
| 2006/0006248 | A1 * | 1/2006 | Wu | 239/17 |

FOREIGN PATENT DOCUMENTS

| | | | |
|---|---|---|---|
| JP | 06105962 | A | 4/1994 |
| JP | 08182864 | A | 7/1996 |
| JP | 11057231 | A | 3/1999 |
| JP | 2002292152 | A | 10/2002 |
| JP | 2006055636 | A | 3/2006 |

* cited by examiner

*Primary Examiner* — Syed A Islam
(74) *Attorney, Agent, or Firm* — Knobbe, Martens, Olson & Bear LLP

(57) ABSTRACT

A dioramic apparatus includes a vessel having an inferior portion and a superior portion. The vessel includes a shell and defines an interior space. The interior space is partially filled by a liquid medium. At least one dioramic scene is disposed in the interior space. A reservoir is in fluid communication with the interior space. The reservoir includes a flow plate defining at least one liquid intake and at least one liquid output port. The at least one liquid intake is configured and arranged for receiving at least a portion of the liquid medium from the interior space when the dioramic apparatus is at least partially inverted. The at least one liquid output port is configured and arranged to output at least a portion of the liquid medium from the reservoir when the vessel is placed in an upright position.

26 Claims, 11 Drawing Sheets

DEVICE FOR CREATING AND DISPLAYING LIQUID-MEDIUM MOVEMENT WITHIN A VESSEL CONTAINING A DIORAMIC SCENE

CROSS-REFERENCE TO RELATED APPLICATIONS

This application is a continuation of and claims priority under 35 U.S.C. §120 to currently U.S. application Ser. No. 13/296,047 (issuing as U.S. Pat. No. 8,393,099) which is a continuation of and claims priority to U.S. Pat. No. 8,056,274 filed Apr. 7, 2009 which claims priority under 35 U.S.C. §119(e) to previously filed U.S. Provisional Patent Application Ser. No. 61/043,990 filed on Apr. 10, 2008, all of which are incorporated in their entirety by reference.

TECHNICAL FIELD

The present invention is directed to devices containing dioramic scenes. The present invention is also directed to devices that create and display movement of a liquid medium within a partially liquid-filled vessel containing a dioramic scene.

BACKGROUND

Fascination for recreating miniaturized versions of specific settings, real, idealized, or even imaginary, has fueled the desire of some people to attempt to create dioramas which may include certain people, places, or events contained within vessels completely filled with a liquid medium. Artificial snowflakes are commonly added to the completely-liquid-filled vessels so that, when the completely-liquid-filled vessels are agitated, the artificial snowflakes may swirl around the diorama before settling due to gravity. The swirling artificial snowflakes may give the appearance of snow falling onto the diorama for a period of time to temporarily enliven and dramatize the diorama.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Detailed Description, which is to be read in association with the accompanying drawings, wherein.

DETAILED DESCRIPTION

The present invention is directed to devices containing dioramic scenes. The present invention is also directed to devices that create and display movement of a liquid medium within a partially liquid-filled vessel containing a dioramic scene.

Figure 1A:
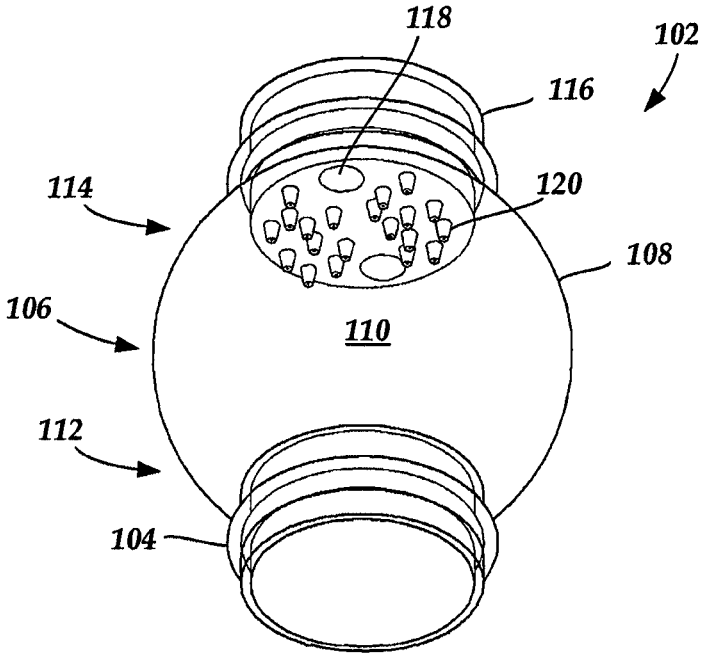
FIG. 1A is a bottom schematic perspective view of one embodiment of a dioramic apparatus, the dioramic apparatus including a reservoir, a vessel, and a base, according to the invention.
Figure 1B:
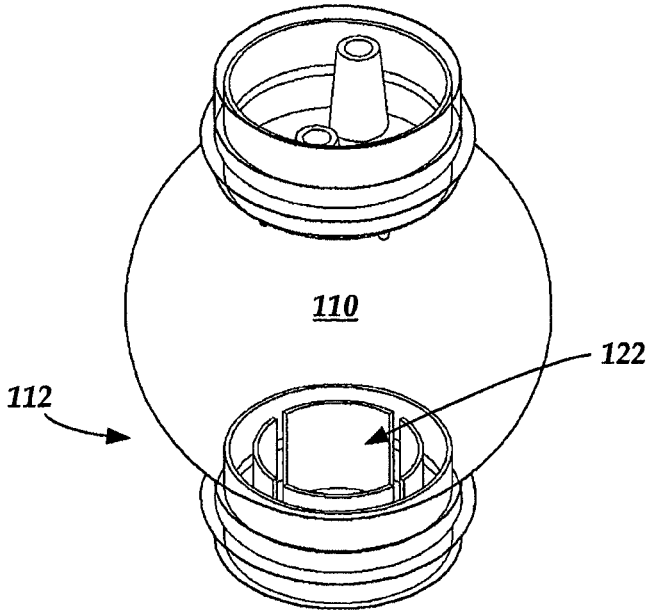
FIG. 1B is a top schematic perspective view of one embodiment of the dioramic apparatus of FIG. 1A, according to the invention.

FIG. 1A is a schematic side view of one embodiment of a dioramic apparatus 102. The dioramic apparatus 102 includes a substantially hollow vessel ("vessel") 106 resting on a base 104. The vessel 106 includes a shell 108 and defines an interior space 110 with an inferior region 112 and a superior region 114. The vessel 106 includes a reservoir 116 disposed in the superior region 114. An inferior surface of the reservoir 116 includes at least one liquid intake 118 and at least one liquid output port 120. As shown in FIG. 1B, a basin 122 is disposed in the inferior region 112 of the interior space 110.

The vessel 106 may be formed from many different rigid materials suitable for retaining liquids (e.g., glass, plastic, or the like). Additionally, the shell 108 of the vessel 106 includes at least one transparent or translucent portion to facilitate viewing of at least a portion of the interior space 110. In some embodiments, the vessel 106 is formed as a unitary structure. In other embodiments, the vessel 106 is formed from multiple pieces of material. The vessel 106 may be formed using many different techniques, including glass-blowing, extrusion, molding, and the like. The vessel 106 may be formed in many different regular shapes, including spherical (see e.g., FIGS. 1A and 2A), cylindrical (see e.g., FIG. 11A), dome-shaped (see e.g., FIG. 13), ovoid (see e.g., FIG. 12), block-shaped, pyramidal, pear-shaped, bell-shaped, cup-shaped (see e.g., FIG. 10), or the like. In at least some embodiments, the vessel 106 may be formed in a combination shape. For example, in at least some embodiments, the vessel 106 has a shape that approximates a dome disposed on one end of a cylinder (see e.g., FIG. 14). In at least some embodiments, the vessel 106 is formed in an irregular (i.e., a non-geometric) shape.

In at least some embodiments, the reservoir 116 is completely disposed within the vessel 106. In at least some embodiments, the reservoir 116 is at least partially disposed external to the vessel 106. In at least some embodiments, the reservoir 116 may be at least partially concealed. In at least some embodiments, the reservoir 116 is formed to resemble a lid coupled to the superior region 114 of the vessel 106, as shown in FIGS. 1A and 1B. In at least some embodiments, the lid-shaped reservoir 116 may also be used to provide access to the interior space 110. In at least some embodiments, the reservoir 116 is configured and arranged to provide a liquid-tight seal with the vessel 106.

Figure 2A:
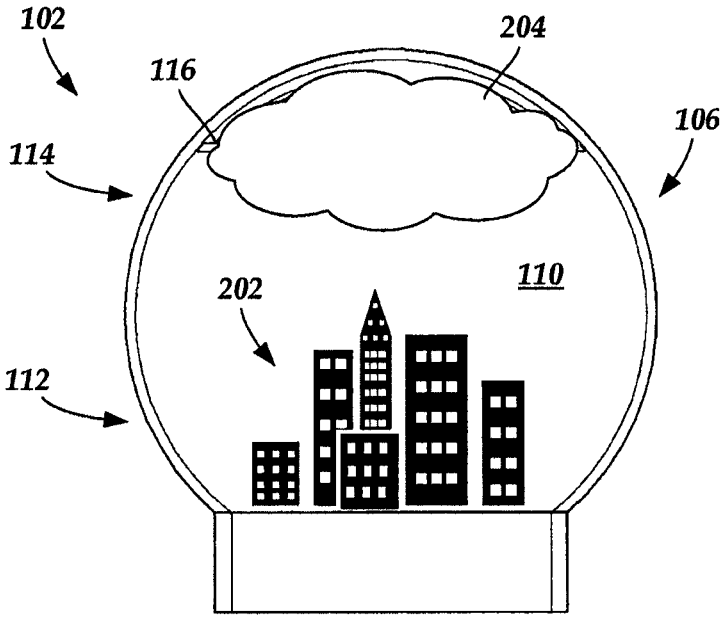
FIG. 2A is a schematic side view of another embodiment of a dioramic apparatus with a dioramic scene disposed therein and a reservoir concealer disposed over a reservoir positioned superior to the dioramic scene, according to the invention.

In at least some embodiments, the reservoir is disposed completely within the vessel 106. In at least some embodiments, the reservoir is concealed within a reservoir concealer. FIG. 2A is a schematic side view of one embodiment of the dioramic apparatus 102. The dioramic apparatus 102 includes a dioramic scene 202 and a reservoir concealer 204. In at least some embodiments, the reservoir concealer 204 is disposed around at least a portion of the reservoir 116. In some embodiments, the reservoir concealer 204 is disposed in the interior space 110. In at least some embodiments, the reservoir concealer 204 includes one or more decorative designs. In at least some embodiments, the reservoir concealer 204 includes a design that relates to the dioramic scene 202. For example, in FIG. 2A, the reservoir concealer 204 is configured and arranged to resemble one or more rain clouds above the dioramic scene 202.

Figure 2B:
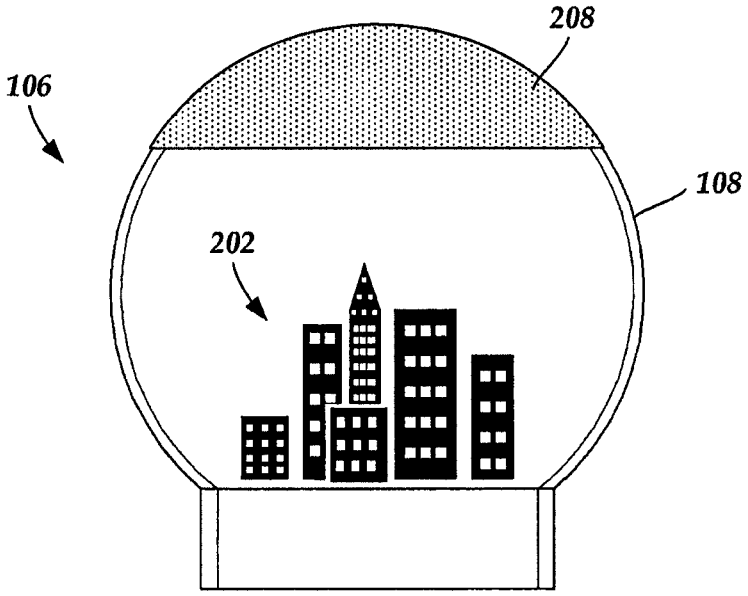
FIG. 2B is a schematic side view of one embodiment of the dioramic apparatus shown in FIG. 2A with a dioramic scene disposed therein and a reservoir concealer positioned superior to the dioramic scene, according to the invention.

In other embodiments, the reservoir concealer is disposed on the shell 108 of the vessel 106. FIG. 2B shows a reservoir concealer 208 disposed on the shell 108 of the vessel 106. In FIG. 2B, the reservoir concealer 208 includes a decorative pattern. In at least some embodiments, the reservoir concealer 208 disposed on the shell 108 of the vessel 106 includes a design that relates to the dioramic scene 202. In at least some embodiments, surface ornamentation (e.g., paint, decals, photographs, stickers, paper, or the like) is applied to the reservoir concealer 208. It will be understood that surface ornamentation can be applied in other locations, as well, such as the shell 108, the dioramic scene 202, the reservoir 116, the base 104, or the like.

The dioramic scene 202 includes one or more dioramas. In at least some embodiments, the dioramic scene 202 includes miniature versions of real places, imagined places, or idealized places. The real places may be of any desired environment, for example, urban, suburban, or bucolic, and may be set in the past, present, or future. For example, in FIG. 2A, a skyline of a city is depicted. In at least some embodiments, a rain forest may be depicted. In at least some embodiments, a mountain range may be depicted. In at least some embodiments, a ship (e.g., a cruise ship, a pirate ship, a sailboat, an ark, or the like) may be depicted on a body of water. In at least some embodiments, an idealized country garden may be depicted. In at least some embodiments, a moonscape may be depicted.

In at least some embodiments, the dioramic scene 202 includes one or more people, either real or fictitious. A depicted person may be famous, infamous, or non-famous. For example, in some embodiments a famous musician may be depicted playing a musical instrument. In at least some embodiments, a famous singer may be depicted singing. In at least some embodiments, a sports icon may be depicted playing a sport. In at least some embodiments, the dioramic scene 202 includes one or more animals, real, extinct, or imaginary. For example, in some embodiments one or more birds or marine animals may be depicted. In at least some embodiments, one or more dinosaurs may be depicted.

In at least some embodiments, the dioramic scene may include one or more photographs. For example, in at least some embodiments, the dioramic scene 202 includes one or more photographs of family members of a user of the dioramic apparatus 102. In at least some embodiments, the one or more photographs are encased in a transparent or translucent fluidtight material. In at least some embodiments, the one or more photographs are incorporated into another picture or other portions of the dioramic scene 202. For example, the one or more photographs may show a group of people. The photograph of the group of people may be placed into a dioramic scene, such as one of the dioramic scenes 202 described above.

The dioramic scene 202 may be positioned anywhere within the vessel 106. In at least some embodiments, the dioramic scene 202 is disposed in the inferior region 112 of the interior space 110. In other embodiments, the dioramic scene 202 is disposed in the superior region 114 of the interior space 110. In at least some embodiments, the dioramic scene 202 is disposed in both the inferior region 112 and the superior region 114 of the interior space 110.

Figure 3A:
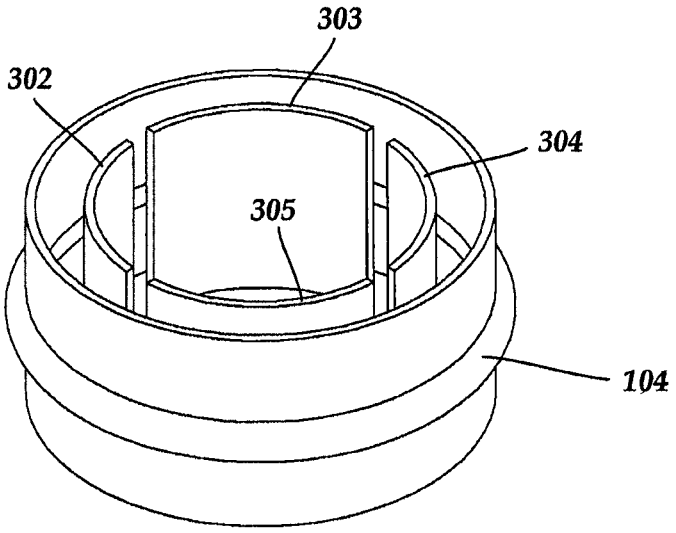
FIG. 3A is a schematic perspective view of one embodiment of a base, according to the invention.

In at least some embodiments, the vessel 106 is self-standing. In other embodiments, the vessel 106 rests on the base 104. FIG. 3A is a schematic perspective view of one embodiment of the base 104. In at least some embodiments, the base 104 includes supports, such as supports 302-305 configured and arranged for supporting the vessel 106, or for supporting the dioramic scene 202 within the vessel 106. The base 104 can be any size or shape suitable for holding the vessel 106. In at least some embodiments, the base 104 is disc-shaped. In at least some embodiments, the base 104 has a diameter that is at least three inches (approximately 80 mm). In at least some embodiments, the base 104 has a diameter that is no greater than 3.5 inches (approximately 90 mm).

Figure 3B:
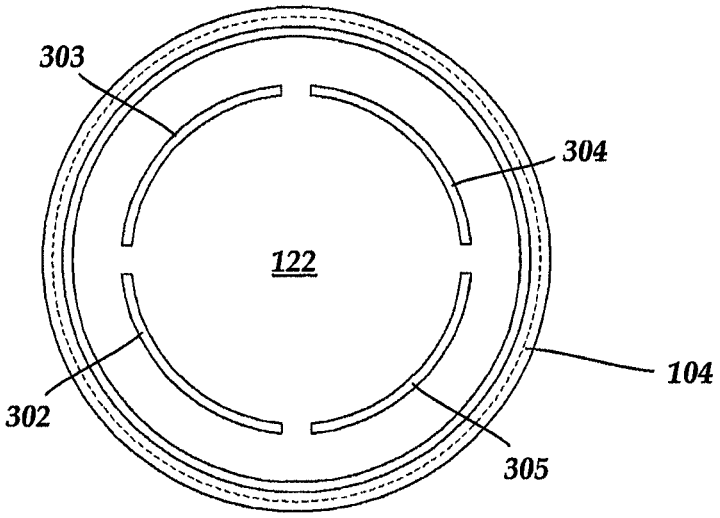
FIG. 3B is a schematic top view of one embodiment of the base shown in FIG. 3A, according to the invention.

FIG. 3B shows a top view of the base 104 and the supports 302-305. In FIGS. 3A-3B the supports 302-305 are arranged in a circular pattern to support the dioramic scene 202. In other embodiments, the supports 302-305 are arranged in other patterns, for example, one or more rectangles, one or more triangles, radial spokes, one or more X-shaped members, and the like or combinations thereof. Additionally, the number of supports 302-305 may vary depending on the amount of space available, the weight of the vessel 106, and the strength of the supports 302-305. For example, there may be one, two, three, four, five, six, seven, eight, nine, ten, or more supports. In at least some embodiments, the basin 122 is included within the base 104. In at least some embodiments, the dioramic scene 202 may be at least partially supported by the supports 302-305. In other embodiments, the dioramic scene 202 may be supported by a meshed or grated surface positioned superior to the basin 122.

The vessel 106 is partially filled with a liquid medium that moves between the reservoir 116 and the basin 122. In at least some embodiments, the vessel 106 is configured and arranged to use gravity to facilitate the movement of the liquid medium between the reservoir 116 and the basin 122. In at least some embodiments, the liquid medium moves onto, or in proximity to, the dioramic scene 202.

Figure 4:
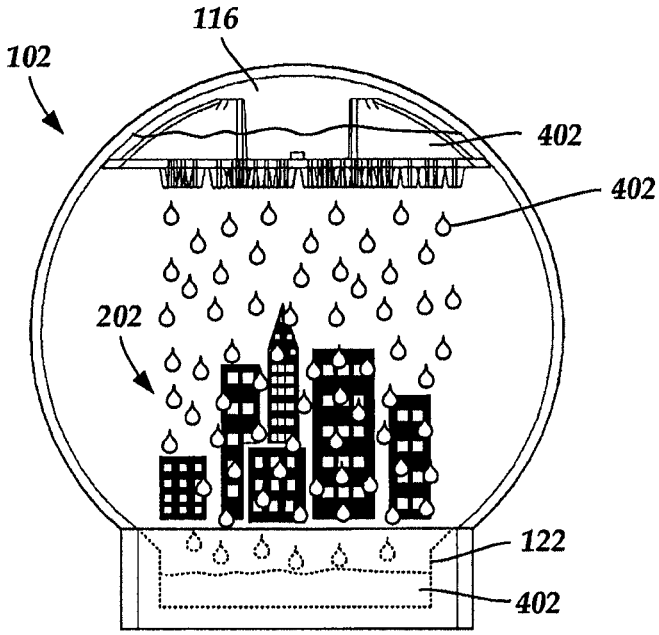
FIG. 4 is a schematic side view of one embodiment of the dioramic apparatus shown in FIG. 2A with a liquid medium being output from a reservoir and into a basin, according to the invention.

FIG. 4 is a schematic view of one embodiment of the vessel 106 partially filled with a liquid medium 402 being output from the reservoir 116 and into the basin 122. In some embodiments, the basin 122 is disposed within the dioramic scene 202. For example, the dioramic scene 202 may depict a cruise ship floating on a body of water. In other embodiments, the basin 122 is disposed beneath the dioramic scene. For example, as shown in FIG. 4 the dioramic scene 202 is formed above the basin 122. In alternate embodiments, the basin 122 may include a moat surrounding the dioramic scene 202 which collects liquid from the dioramic scene 202. In at least some embodiments, the basin 122 is at least partially disposed within the base 104.

In at least some embodiments, the amount of liquid medium disposed in the vessel 106 is less than the volume of the reservoir 116. In at least some embodiments, the amount of liquid medium disposed in the vessel 106 is equal to approximately three-quarters of the volume of the reservoir 116. In at least some embodiments, the volume of the basin 122 is greater than the volume of the reservoir 106. In at least some embodiments, the volume of the basin 122 is equal to the volume of the reservoir 116. In at least some embodiments, the amount of liquid medium disposed in the vessel 106 is equal to the volume of the reservoir 116. In at least some embodiments, the amount of liquid medium disposed in the vessel 106 is equal to the volume of the basin 122. In at least some embodiments, the amount of liquid medium disposed in the vessel 106 is greater than the volume of at least one of the reservoir 116 or the basin 122. In at least some embodiments, the amount of liquid medium disposed in the vessel 106 is less than the volume of at least one of the reservoir 116 or the basin 122.

In at least some embodiments, the amount of liquid medium 402 disposed in the vessel 106 is no greater than the volume of the vessel 106. In at least some embodiments, the amount of liquid medium 402 disposed in the vessel 106 is no greater than three-fourths of the volume of the vessel 106. In at least some embodiments, the amount of liquid medium 402 disposed in the vessel 106 is no greater than one half of the volume of the vessel 106. In at least some embodiments, the amount of liquid medium 402 disposed in the vessel 106 is no greater than one quarter of the volume of the vessel 106. In at least some embodiments, the amount of liquid medium 402 disposed in the vessel 106 is no less than five percent of the volume of the vessel 106. In at least some embodiments, the amount of liquid medium 402 disposed in the vessel 106 is no less than fifteen percent of the volume of the vessel 106. In at least some embodiments, the amount of liquid medium 402 disposed in the vessel 106 is no less than one quarter of the volume of the vessel 106.

Many different types of inert liquids may be used to form the liquid medium 402. For example, the liquid medium 402 may include one or more water-based liquids, one or more oil-based liquids, and the like. Additionally, the liquid medium 402 may include one or more additives, such as one or more anti-microbial agents, one or more contrast agents, glitter, one or more surfactants, one or more thickening agents, one or more anti-fogging agents, and the like or combinations thereof.

The liquid medium 402 is input to and output from the reservoir 116 through a flow plate disposed on an inferior surface of the reservoir 116. In at least some embodiments, the flow plate includes at least one liquid intake 118 and at least one liquid output port 120. In at least some embodiments, the flow plate is a unitary structure. In at least some embodiments, the flow plate is formed from a plurality of pieces that may be assembled together. In at least some embodiments, the flow plate is formed from a flexible material.

In at least some embodiments, the flow plate has a shape that approximately matches the shape of the vessel 106 along a transverse axis of the vessel 106. In at least some embodiments, the flow plate has a shape that approximately matches the shape of the vessel 106 along an oblique axis of the vessel 106. In at least some embodiments, the flow plate has a diameter that is smaller than the diameter of at least one of the inferior region 112 of the vessel 106 or the base 104. In at least some embodiments, the flow plate has a diameter that is equal to the diameter of at least one of the inferior region 112 of the vessel 106 or the base 104. In at least some embodiments, the flow plate has a diameter that is greater than the diameter of at least one of the inferior region 112 of the vessel 106 or the base 104. In at least some embodiments, when the flow plate has a diameter that is greater than the diameter of at least one of the inferior region 112 of the vessel 106 or the base 104, the flow plate can be bent or folded to gain insertion into the vessel 106. In at least some embodiments, when the flow plate has a diameter that is greater than the diameter of at least one of the inferior region 112 of the vessel 106 or the base 104, the flow plate can be disposed in the vessel 106 in pieces and subsequently assembled.

Figure 5A:
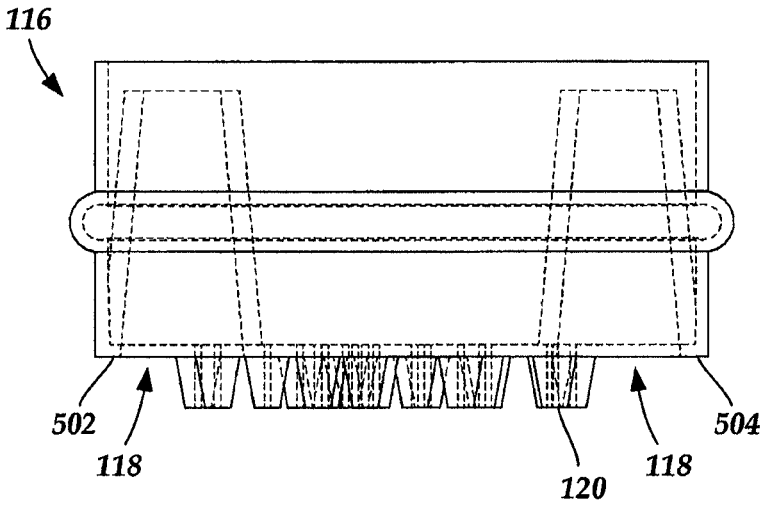
FIG. 5A is a schematic side view of one embodiment of a reservoir, the reservoir having a flow plate along an inferior surface that includes liquid intakes and liquid output ports, according to the invention.
Figure 5B:
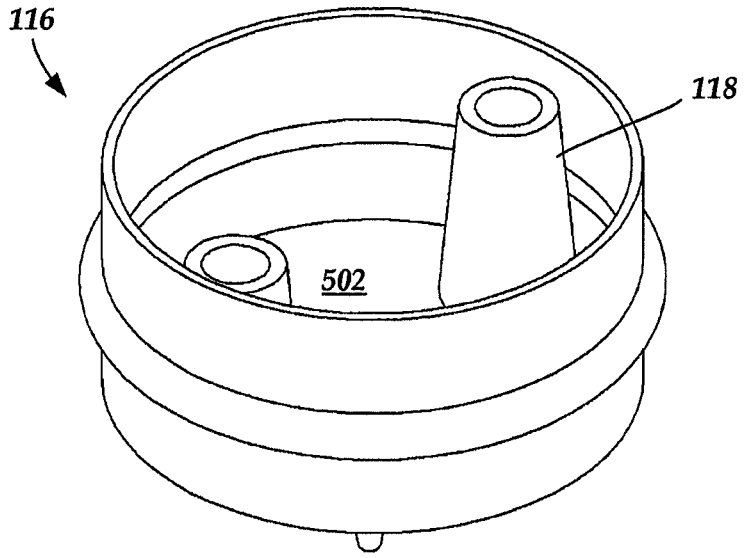
FIG. 5B is a top schematic perspective view of one embodiment of the reservoir shown in FIG. 5A, according to the invention.
Figure 5C:
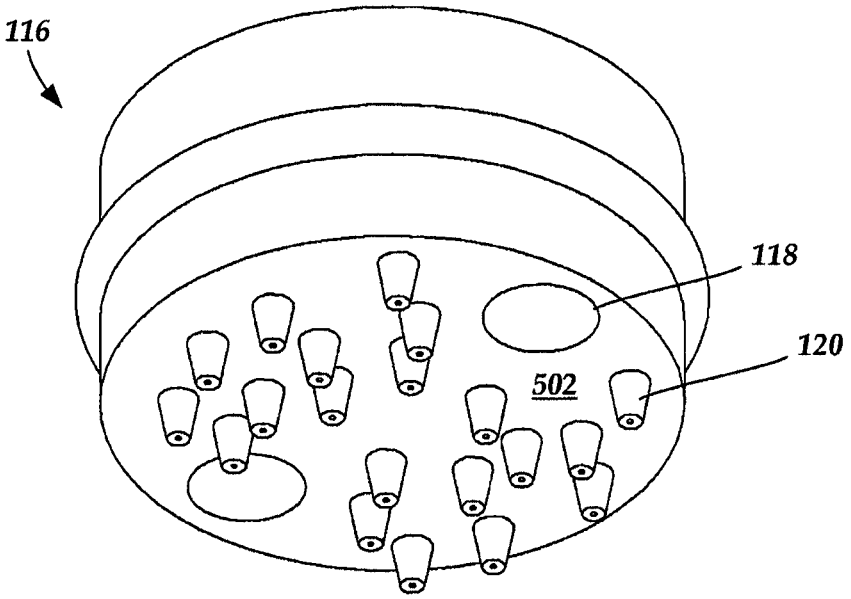
FIG. 5C is a bottom schematic perspective view of one embodiment of the reservoir shown in FIG. 5A, according to the invention.

FIG. 5A is a schematic side view of one embodiment of the reservoir 116. The reservoir 116 includes a flow plate 502 disposed on an inferior surface 504 of the reservoir 116. The flow plate 502 includes at least one liquid intake 118 and at least one liquid output port 120. In at least some embodiments, the reservoir 116 is disposed in the superior region 114 of the vessel 106. FIGS. 5B and 5C show perspective views of the flow plate 502 of the reservoir 116 with liquid intakes, such as liquid intake 118, and liquid output ports, such as liquid output port 120. It will be understood that, in at least some embodiments, at least a portion of the reservoir 116 has a transverse shape that matches the transverse shape of the superior region 114 of the vessel 106.

Figure 6A:
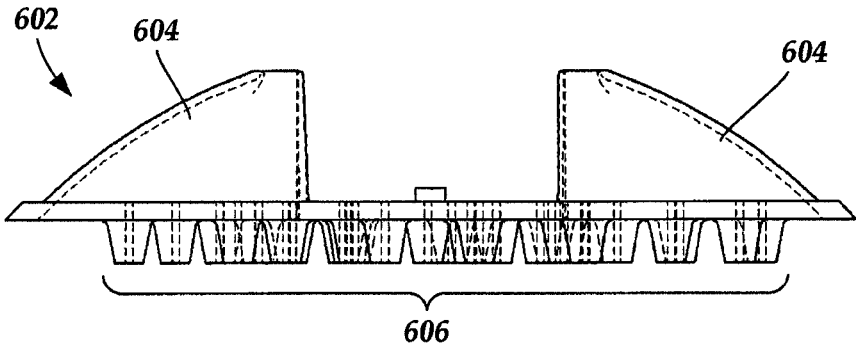
FIG. 6A is a schematic side view of another embodiment of flow plate, the flow plate including liquid intakes and liquid output ports, according to the invention.
Figure 6B:
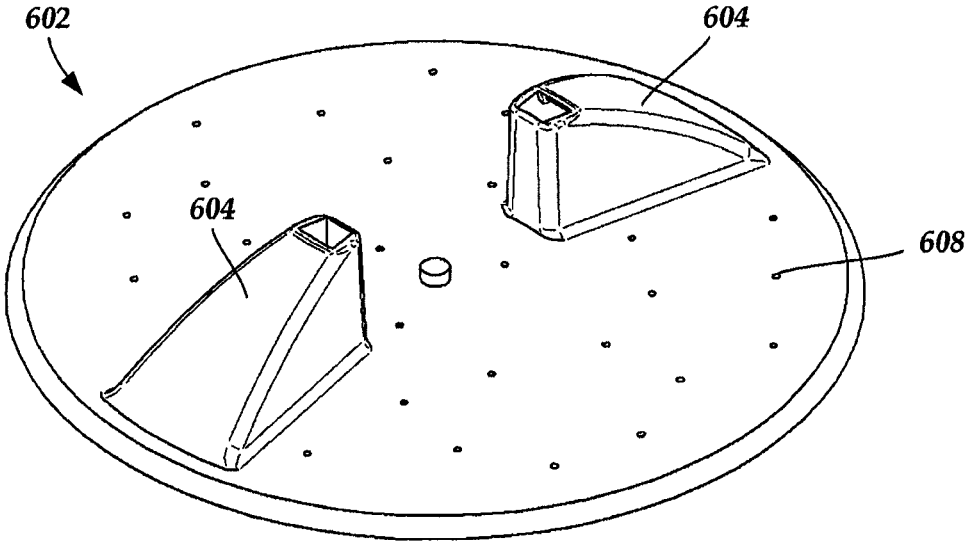
FIG. 6B is a top schematic perspective view of one embodiment of the flow plate shown in FIG. 6A, according to the invention.
Figure 6C:
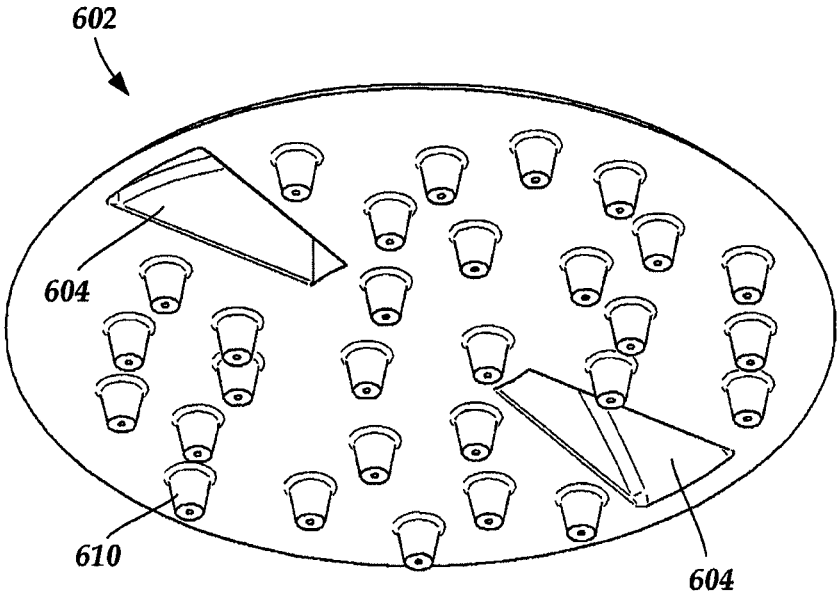
FIG. 6C is a bottom schematic perspective view of one embodiment of the flow plate shown in FIG. 6A, according to the invention.
Figure 7A:
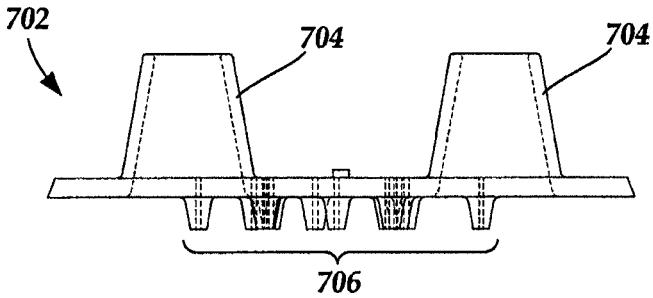
FIG. 7A is a schematic side view of another embodiment of a flow plate, the flow plate including liquid intakes and liquid output ports, according to the invention.
Figure 7B:
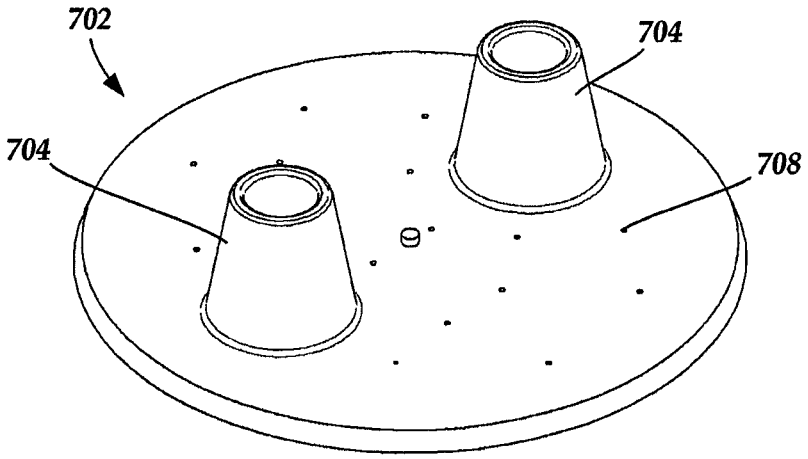
FIG. 7B is a top schematic perspective view of one embodiment of the flow plate shown in FIG. 7A, according to the invention.
Figure 7C:
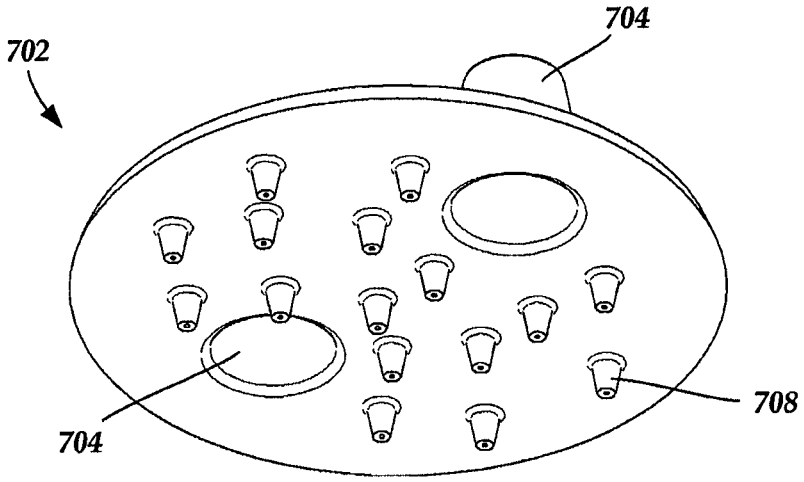
FIG. 7C is a bottom schematic perspective view of one embodiment of the flow plate shown in FIG. 7A, according to the invention.

In at least some embodiments, the reservoir 116 is formed by disposing a flow plate within the interior space 110 of the vessel 106 such that the flow plate forms a seal around an inner surface of the shell 108, thereby forming the reservoir 116 in the portion of the interior space 110 superior to the flow plate. FIG. 6A shows a schematic side view of another embodiment of a flow plate 602. The flow plate 602 includes liquid intakes 604 and liquid output ports 606. FIGS. 6B and 6C show perspective views of liquid intakes 604 and liquid output ports 608 and 610 of the flow plate 602. FIG. 7A is schematic side view of yet another embodiment of a flow plate 702. The flow plate 702 includes liquid intakes 704 and liquid output ports 706. FIGS. 7B and 7C show perspective views of liquid intakes 704 and liquid output ports 708 and 710 of the flow plate 702.

The flow plate 502, 602, or 702 can be formed from many different types of materials suitable for retaining liquids and for forming at least one liquid intake 118, 604, or 704 and at least one liquid output port 120, 606, or 706. In some embodiments, the flow plate 502, 602, or 702 is formed from flexible materials, such as plastic or silicone. In other embodiments, the flow plate 502, 602, or 702 is formed from rigid materials, such as plastic (e.g., acrylonitrile butadiene styrene, or the like), composite, metal, or the like or combinations thereof. In at least some embodiments, the flow plate 502, 602, or 702 is hydrophilic. In at least some embodiments, the flow plate 502, 602, or 702 is hydrophilic enough to allow the liquid medium 402 to flow freely through the at least one liquid output port 120, 606, or 706 without beading up. In at least some embodiments, the shape of the at least one liquid intake 118, 604, or 704 may be at least partially based on the shape of the vessel 106. For example, in at least some embodiments, the shape of the liquid intakes 118, 604, or 704 may partially conform to the shape of the superior region 114 of the vessel 106.

In at least some embodiments, each of the liquid intakes 118, 604, or 704 includes an open-ended conical shape tapering in a superior direction (see e.g., 604 of FIG. 6A). In at least some embodiments, the liquid intakes 118, 604, or 704 have a sufficient length to prevent the liquid medium 402 contained in the reservoir 116 from being output from the reservoir 116 by passing through the liquid intakes 118, 604, or 704 when the vessel 106 is in an upright position. Thus, when the vessel 106 is in an upright position and at least some of the liquid medium 402 is contained within the reservoir 116, the liquid medium 402 is output through the liquid output ports 120, 606, or 706 and not through the liquid intakes 118, 604, or 704.

In some embodiments, the vessel 106 is inverted to allow the liquid medium 402 to be input to the reservoir 116. In at least some embodiments, the diameter of the liquid intakes 118, 604, or 704 is sufficiently sized to allow approximately all of the liquid medium 402 contained in the vessel 106 to be input to the reservoir 116 within a selected amount of time. In at least some embodiments, when the vessel 106 is inverted, the diameter of the liquid intakes 118, 604, 704 is sufficiently sized to allow approximately all of the liquid medium 402 contained in the vessel 106 to be input to the reservoir 116 within one second. In at least some embodiments, when the vessel 106 is inverted, the diameter of the liquid intakes 118, 604, 704 is sufficiently sized to allow approximately all of the liquid medium 402 contained in the vessel 106 to be input to the reservoir 116 within two seconds. In at least some embodiments, when the vessel 106 is inverted, the diameter of the liquid intakes 118, 604, or 704 is sufficiently sized to allow approximately all of the liquid medium 402 contained in the vessel 106 to be input to the reservoir 116 within three seconds. In at least some embodiments, when the vessel 106 is inverted, the diameter of the liquid intakes 118, 604, or 704 is sufficiently sized to allow approximately all of the liquid medium 402 contained in the vessel 106 to be input to the reservoir 116 within five seconds. In other embodiments, a pump may be used to pump the liquid medium 402 into the reservoir 116. Thus, in at least some embodiments, when a pump is used to pump the liquid medium 402 into the reservoir 116, the vessel 106 need not be inverted.

In at least some embodiments, each of the at least one liquid output ports 120, 606, or 706 include an open-ended conical shape tapering in an inferior direction. The tapering may prevent the liquid medium 402 from recombining and dripping down an inner surface of the vessel 106. There may be many different numbers of liquid output ports 120, 606, or 706 depending on the desired liquid-medium movement. For example, there may be one, two, three, four, five, six, seven, eight, nine, ten, eleven, twelve, fifteen, twenty, twenty-five, thirty, forty, fifty, one hundred, two hundred, or more liquid output ports 120, 606, or 706. Additionally, the size and the shape of the at least one liquid output port 120, 606, or 706 may effect the rate of output of the liquid medium 402. For example, liquid output ports 120, 606, or 706 of a given diameter may output the liquid medium 402 at a faster rate than liquid output ports 120, 606, or 706 with a smaller diameter. The output rate may be altered to create desired liquid-medium movement. For example, at least one liquid output port 120, 606, or 706 of a given size may be employed to simulate a relatively light rain and at least one liquid output port 120, 606, or 706 of a larger size may be employed to simulate a relatively strong rain. In at least some embodiments, the at least one liquid output port 120, 606, or 706 has a diameter that is at least 0.02 inches (0.05 cm). In at least some embodiments, the at least one liquid output port 120, 606, or 706 has a diameter that is at least 0.03 inches (0.08 cm). In at least some embodiments, the at least one liquid output port 120, 606, or 706 has a diameter that is no greater than 0.04 inches (0.1 cm). In at least some embodiments, the at least one liquid output port 120, 606, or 706 has a diameter that is no greater than 0.03 inches (0.08 cm).

In at least some embodiments, the at least one liquid output port 120, 606, or 706 is sized such that drainage of the liquid medium 402 from the reservoir 116 through the at least one liquid output port 120, 606, or 706 takes at least 10 seconds. In at least some embodiments, the at least one liquid output port 120, 606, or 706 is sized such that drainage of the liquid medium 402 from the reservoir 116 through the at least one liquid output port 120, 606, or 706 takes at least 20 seconds. In at least some embodiments, the at least one liquid output port 120, 606, or 706 is sized such that drainage of the liquid medium 402 from the reservoir 116 through the at least one liquid output port 120, 606, or 706 takes at least 30 seconds. In at least some embodiments, the at least one liquid output port 120, 606, or 706 is sized such that drainage of the liquid medium 402 from the reservoir 116 through the at least one liquid output port 120, 606, or 706 takes at least 40 seconds. In at least some embodiments, the at least one liquid output port 120, 606, or 706 is sized such that drainage of the liquid medium 402 from the reservoir 116 through the at least one liquid output port 120, 606, or 706 takes at least 50 seconds. In at least some embodiments, the at least one liquid output port 120, 606, or 706 is sized such that drainage of the liquid medium 402 from the reservoir 116 through the at least one liquid output port 120, 606, or 706 takes at least 60 seconds.

In at least some embodiments, the at least one liquid output port 120, 606, or 706 is sized such that drainage of the liquid medium 402 from the reservoir 116 through the at least one liquid output port 120, 606, or 706 takes at least 70 seconds.

When a plurality of liquid output ports 120, 606, or 706 are employed, the liquid output ports 120, 606, or 706 may be positioned in many different patterns along the flow plate 502, 602, or 702. For example, the liquid output ports 120, 606, or 706 may be arranged in a pattern (e.g., a random pattern, a ringed pattern, a square pattern, or the like or combinations thereof).

Additionally, the size and the number of liquid output ports 120, 606, or 706 may affect the amount of time it takes for a reservoir 116 that is full of the liquid medium 402 to empty. For example, adding additional liquid output ports 120, 606, or 706 may decrease the amount of time it takes to empty a full reservoir 116. In at least some embodiments, one or more items, such as thread, wire, toothpicks, and the like or combinations thereof, may be disposed in the at least one liquid output port 120, 606, or 706 to further affect liquid-medium movement. In at least some embodiments, the at least one liquid output port 120, 606, or 706 may be disposed in a vessel 106 at a non-horizontal angle to further affect liquid-medium movement. In at least some embodiments, one or more additives may be added to the liquid medium 402 to affect the liquid-medium movement. For example, liquid-medium movement may be affected by adding one or more surfactants to reduce the surface tension of the liquid medium 402 or adding one or more thickening agents to increase the viscosity of the liquid medium 402.

In some embodiments, the flow plate 502, 602, or 702 includes at least one liquid output port 120, 606, or 706 and a hinged door. Pivoting of the hinged door facilitates input of the liquid medium 402 into the reservoir 116. In at least some embodiments, the hinged-door pivots in a superior direction so that the liquid medium 402 may enter the reservoir 116 while the hinged-door is pivoted to an open position by the force of gravity, such as when the vessel 106 is inverted. Once the vessel 106 is righted, the hinged door may pivot back to a closed position. In at least some embodiments, the liquid medium 402 within the reservoir 116 may be output through the at least one liquid output port 120, 606, or 706 and may not be output through the hinged door in a closed position.

Figure 8A:
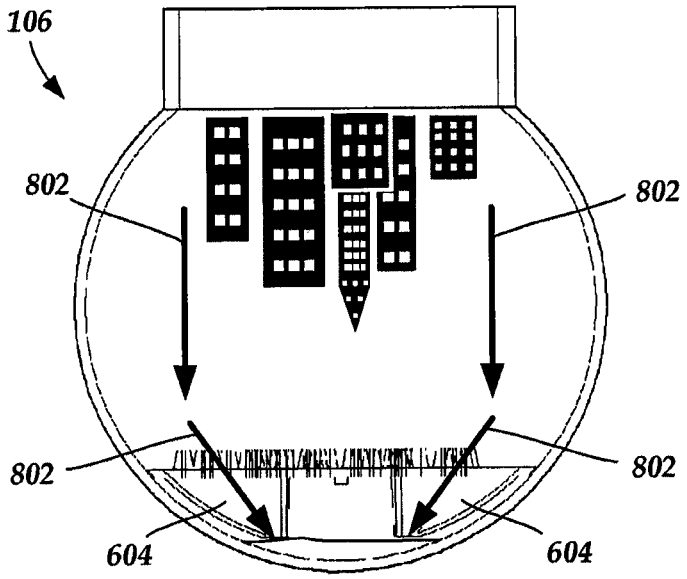
FIG. 8A is a schematic view of one embodiment of the dioramic apparatus shown in FIG. 2A in an inverted position with a liquid medium being input to a reservoir via liquid intakes, according to the invention.
Figure 8B:
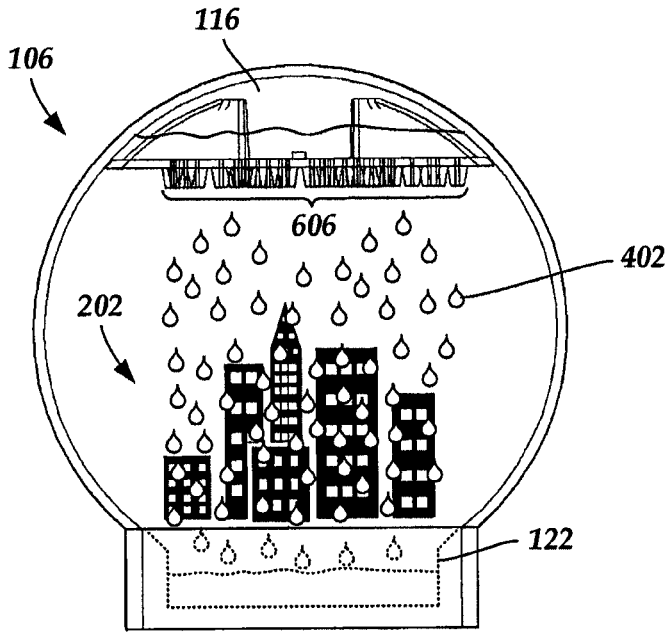
FIG. 8B is a schematic view of one embodiment of the dioramic apparatus shown in FIG. 2A with a liquid medium being output from liquid output ports in a manner that simulated rainfall and collecting in a basin, according to the invention.

In some embodiments, the dioramic apparatus is configured and arranged to cause the liquid medium to move in a specific manner on or around the dioramic scene following an inversion of the vessel. FIG. 8A is a schematic view of one embodiment of the vessel 106 in an inverted position. The liquid medium (not shown in FIG. 8A) is input to the reservoir 116 via the liquid intakes 118, 604, or 704, as shown by directional arrows 802. Once the liquid medium 402 is disposed in the reservoir 116, the vessel 106 may be righted so that the liquid medium 402 contained within the reservoir 116 can be output through the liquid output ports 120, 606, or 706. In some embodiments, the vessel 106 can be inverted without lifting the base 104. In other embodiments, the vessel 106 and the base 104 are attached such that the vessel 106 and the base 104 are inverted together. FIG. 8B is a schematic view of one embodiment of the vessel 106 with the liquid medium 402 being output from the liquid output ports 120, 606, or 706. In FIG. 8B, the liquid medium 402 is being output from the liquid output ports 120, 606, or 706 in a manner that simulates rainfall. The output liquid medium 402 is falling onto the dioramic scene 202 and collecting in the basin 122.

Figure 9:
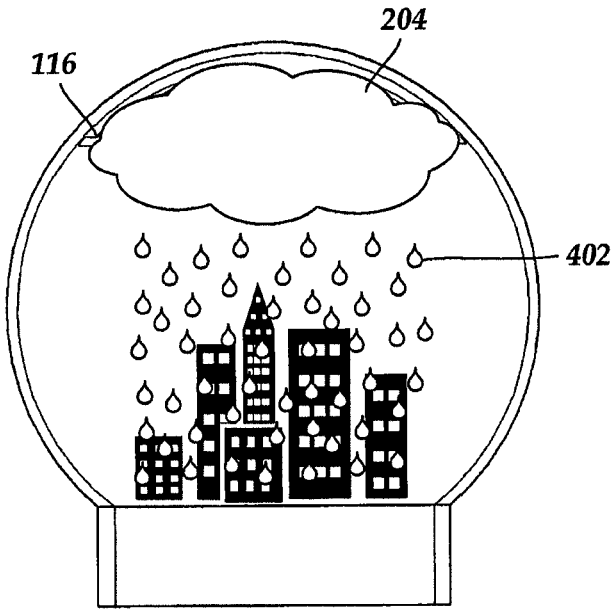
FIG. 9 is a schematic side view of one embodiment of the dioramic apparatus shown in FIG. 2A with simulated rain appearing to fall from a cloud onto a dioramic cityscape in a vessel, according to the invention.

In at least some embodiments, the reservoir 116 may be concealed by a reservoir concealer. FIG. 9 is a schematic side view of one embodiment of the dioramic apparatus 106 with the reservoir concealer 204 surrounding a portion of the reservoir 116 to make it appear as though the liquid medium 402 output from the reservoir 116 is rain falling from a cloud.

In alternate embodiments, a pump may be placed in contact with the basin 122 that pumps the liquid medium 402 from the basin 122 to the reservoir 116. In at least some embodiments, when the pump is used to pump the liquid medium 402 from the basin 122 to the reservoir 116, the liquid medium 402 may continually be output from the liquid output ports 120, 606, or 706 without needing the vessel 106 to be inverted to input the liquid medium 402 to the reservoir 116 after the reservoir 116 empties. In at least some embodiments, the base 104 may be used to conceal the basin 122. In at least some embodiments, the base 104 may be used to conceal one or more pumps.

In at least some embodiments, the dioramic apparatus 102 may be used in conjunction with other items. For example, in one embodiment, the vessel 106 may be sized and shaped to be substantially planar and positioned in front of one or more pictures, posters, signs, photographs, or the like.

Figure 10:
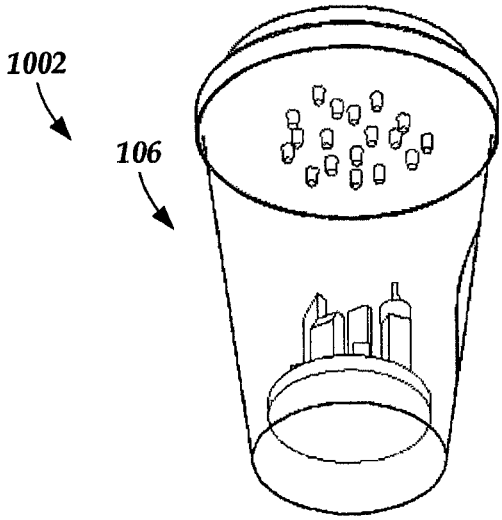
FIG. 10 is a schematic perspective view of one embodiment of a dioramic apparatus with a disposable-coffee-cup shape, according to the invention.

In at least some embodiments, the vessel 106 may be formed into a novelty shape. For example, in some embodiments the vessel 106 may have a disposable-coffee-cup shape. FIG. 10 is a schematic perspective view of one embodiment of a dioramic apparatus 1002 with a disposable-coffee-cup shape. In at least some embodiments, a reservoir may be defined in a lid that resembles a disposable lid for a disposable coffee cup. In some embodiments, the vessel 1006 may be completely transparent or translucent. In other embodiments, only a portion of the vessel 106 may be transparent or translucent.

Figure 11A:
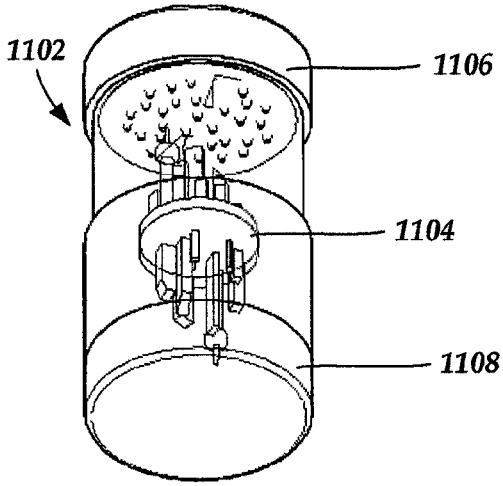
FIG. 11A is a schematic perspective view of one embodiment of a dioramic apparatus with a cylindrical vessel with a two-sided dioramic scene and two reservoirs at opposite ends of the tube-shaped dioramic apparatus, according to the invention.
Figure 11B:
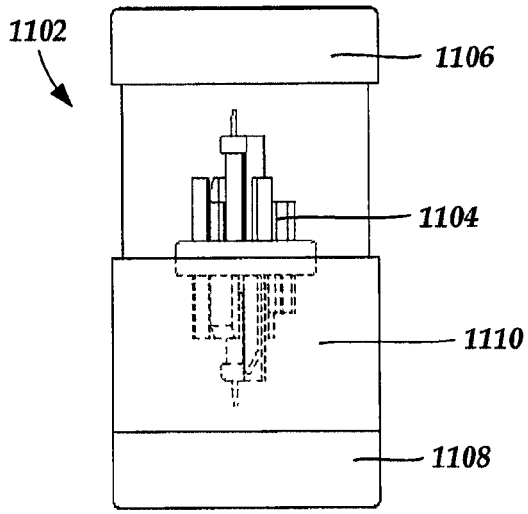
FIG. 11B is a schematic side view of one embodiment of the cylindrical dioramic apparatus shown in FIG. 11A, according to the invention.

In at least some embodiments, the vessel 106 may have an elongated shape (e.g., a cylinder, an hourglass, a tube-shape, or the like) and may contain a multi-sided dioramic scene. FIG. 11A is a schematic perspective view of one embodiment of a dioramic apparatus 1102 with a two-sided dioramic scene 1104 and two reservoirs 1106 and 1108 at opposite ends of the dioramic apparatus 1102. FIG. 11B is a schematic side view of one embodiment of the dioramic apparatus 1102. In at least some embodiments, the dioramic apparatus 1102 includes a slidable blinder 1110 configured and arranged for facilitating viewing of one side of the two-sided dioramic scene 1104, while obstructing the view of the other side of the two-sided dioramic scene 1104. In at least some embodiments, liquid medium within the dioramic apparatus 1102 may be positioned in the currently inferior reservoir 1106 or 1108 and the blinder 1110 may be slid to the opposite end of the dioramic apparatus 1102 from the liquid medium. The dioramic apparatus 1102 may be inverted so that the liquid medium moves across a superior side of the two-sided dioramic apparatus 1104 to the (now inferior) reservoir 1106 or 1108, while the inferior side of the two-sided dioramic apparatus 1104 and the other (now inferior) reservoir 1106 or 1108 is covered from view by the blinder 1110. Once the liquid medium is collected in the (now inferior) reservoir 1106 or 1108, the blinder 1110 may be slid to the opposite end of the dioramic apparatus 1102 and the dioramic apparatus 1102 may again be inverted.

In alternate embodiments, the dioramic apparatus 1102 may include two or more dioramic scenes (such as a first dioramic scene and a second dioramic scene) positioned at opposite ends of the vessel 106. In at least some embodiments, the dioramic apparatus 1102 may be pivotable along a pivot-point positioned between the two or more dioramic scenes. In at least some embodiments, the dioramic apparatus 1102 may be pivoted (either manually or by an automated means) so that the liquid medium moves from a region surrounding the first dioramic scene to a region surrounding the second dioramic scene.

Figure 12:
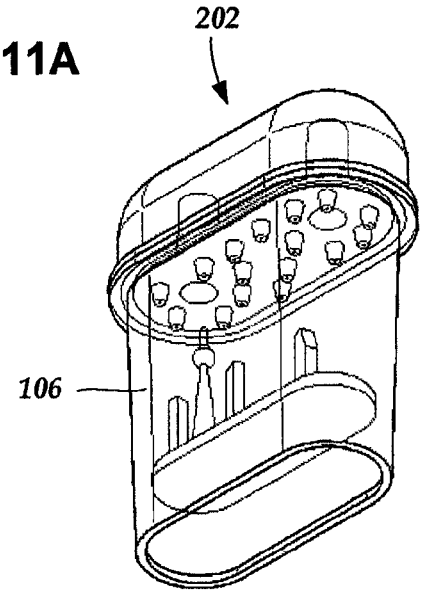
FIG. 12 is a schematic perspective view of one embodiment of a dioramic apparatus with an ovoid-shaped vessel, according to the invention.
Figure 13A:
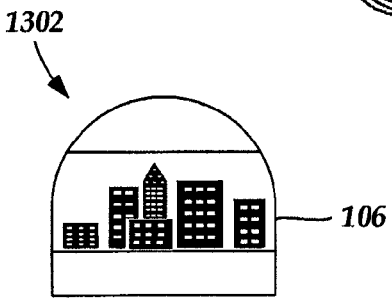
FIG. 13A is a schematic side view of one embodiment of a dioramic apparatus with a dome-shaped vessel, according to the invention.
Figure 13B:
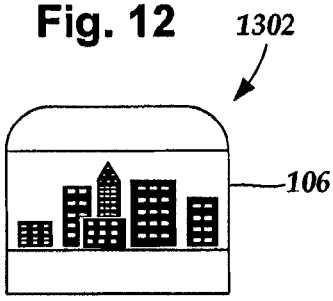
FIG. 13B is a schematic side view of another embodiment of a dioramic apparatus with a dome-shaped vessel, according to the invention.
Figure 14:
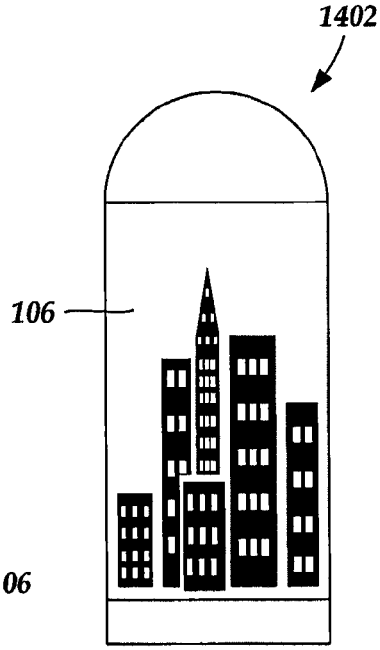
FIG. 14 is a schematic side view of one embodiment of a dioramic apparatus with a vessel having a shape that approximates a dome disposed on one end of a cylinder, according to the invention.

As discussed above, many different possible shapes may be used for the vessel 106. FIG. 12 is a schematic perspective view of one embodiment of a dioramic apparatus 1202 having a vessel 106 that is ovoid-shaped. FIGS. 13A-13B are schematic side views of two different embodiments of a dioramic apparatus 1302 having a vessel 106 that is dome-shaped. FIG. 14 is a schematic side view of one embodiment of a dioramic apparatus 1402 having a vessel 106 with a shape that approximates a dome disposed on one end of a cylinder. In FIG. 14, a superior portion of the vessel 106 is dome-shaped while an inferior region of the vessel 106 is cylindrical. In FIG. 14, the dome-shaped superior region is shaped similarly to the dome-shaped vessel of FIG. 13A. It will be understood, however, that the dome-shaped superior region can also be shaped similarly to the dome-shaped vessel of FIG. 13B.

In at least some embodiments, the vessel 106 may be configured and arranged to simulate other types of liquid-medium movement besides rain. For example, in at least some embodiments, the liquid output ports 120, 606, or 706 and the dioramic scene 202 are configured and arranged to simulate a cascading river or a waterfall. In at least some embodiments, the reservoir 116 may be at least partially concealed within a portion of the dioramic scene 202. In at least some embodiments, the liquid output ports 120, 606, or 706 are oriented at an angle that is approximately vertical.

In at least some embodiments, one or more special effects may be added to the dioramic apparatus 102. For example, in at least some embodiments, one or more light-emitting devices may be disposed at selected locations within the interior space 110 or even outside of the vessel 106. In at least some embodiments, the one or more light-emitting devices may be used to simulate various occurrences, either natural or man-made. For example, one or more light-emitting devices may be used to simulate flashes of lightning, a light on a ship, a light on a lighthouse, a light on a buoy, lights on a skyline, and the like or combinations thereof. In at least some embodiments, the base 104 may be used to conceal one or more power sources used to power the one or more light-emitting devices.

In at least some embodiments, one or more sound-emitting devices may be disposed in or on the dioramic apparatus 102. In at least some embodiments, the one or more sound-emitting devices may be used play one or more songs, riffs, melodies, or jingles. In at least some embodiments, the one or more sound-emitting devices may be used to simulate various occurrences, either natural or man-made. For example, one or more sound-emitting devices may be used to simulate water movement, thunder, wild life, sea life, ship horns, fog horns, street noise, people talking, people singing, and the like or combinations thereof. In at least some embodiments, the base 104 may be used to conceal the one or more sound-emitting devices. In at least some embodiments, the base 104 may be used to conceal the one or more power sources used to power the one or more sound-emitting devices.

In at least some embodiments, the base 104 may rotate the vessel 106 at one or more selected numbers of revolutions per minute. In at least some embodiments, the base 104 may shake the vessel 106 at one or more selected rates. For example, the shaking may be used to simulate a natural disaster, such as an earthquake, or to simulate the motion of a body of water (e.g., a storm, one or more waves, an eddy, or the like) depicted in the dioramic scene 202.

In some embodiments, the dioramic scene 202 may be three-dimensional. In other embodiments, the dioramic scene 202 may be two-dimensional. In at least some embodiments, the dioramic scene 202 includes one or more sleeves into which one or more pictures, posters, signs, photographs, stickers, decals, or the like (or combinations thereof) may be inserted. In at least some embodiments, the dioramic scene 202 may include one or more pictures, posters, signs, photographs, stickers, decals, or the like (or combinations thereof) coupled to one or more surfaces of the vessel 106. The one or more pictures, posters, signs, photographs, stickers, decals, or the like (or combinations thereof) may be coupled to the vessel 106 using many different techniques including, for example, adhering, affixing, magnetic (or static) attraction, and the like or combinations thereof.

The above specification, examples and data provide a description of the manufacture and use of the composition of the invention. Since many embodiments of the invention can be made without departing from the spirit and scope of the invention, the invention also resides in the claims hereinafter appended.

What is claimed is:

1. A storm-simulating apparatus comprising:

an interior space visible from outside the apparatus and a reservoir adjacent to the interior space;

a liquid medium;

a flow plate in fluid communication with the interior space;

wherein the flowplate comprises at least one liquid output port configured to output at least a portion of the liquid medium from the reservoir into the interior space, thereby displacing gas in the interior space with the liquid medium;

at least one device which emits light or sound; and a pump connected to the reservoir to move the liquid medium to the reservoir.

2. The apparatus of claim 1, further comprising a base to receive at least part of the liquid medium.

3. The apparatus of claim 1, wherein the flow plate has a circumference that is shaped to match the shape of an inner surface of the apparatus along a transverse axis of the apparatus.

4. The apparatus of claim 1, further comprising a reservoir concealer.

5. The apparatus of claim 1, wherein the vessel is self-standing.

6. The apparatus of claim 2, further comprising base connected to the pump.

7. The apparatus of claim 2, wherein the flow plate has a diameter that is no greater than the diameter of the base.

8. The apparatus of claim 2, further comprising a dioramic scene positioned superior to the base.

9. The apparatus of claim 2, further comprising a dioramic scene positioned within the base.

10. The apparatus of claim 1, wherein the at least one device emits both light and sound.

11. The apparatus of claim 10, wherein the at least one device emits lights and sounds simulating a storm.

12. The apparatus of claim 1, further comprising at least one of a thread, a wire, or a toothpick extending from the at least one liquid output port.

13. The apparatus of claim 1, wherein the apparatus is at least one of spherical, cylindrical, ovoid, disposable-coffee-cup shaped, or dome-shaped.

14. The apparatus of claim 1, wherein the liquid medium comprises at least one of water, oil, an anti-microbial agent, a contrast agent, glitter, a surfactant, a thickening agent, or an anti-fogging agent.

15. A storm-simulating apparatus comprising:

an interior space visible from outside the apparatus and a reservoir adjacent to the interior space;

a liquid medium;

a flowplate comprising at least one liquid input port and at least one liquid output port;

at least one device which emits light or sound;

wherein the at least one liquid output port is configured to output at least a portion of the liquid medium from the reservoir into the interior space;

wherein the at least one liquid input port is configured to input at least a portion of the liquid medium from the interior space into the reservoir; and wherein the sizes of the liquid intake port and the liquid output port are such that the amount of time it takes the liquid medium to move from the reservoir to the interior space is at least about double the amount of time it takes the liquid medium to move from the interior space to the reservoir.

16. The apparatus of claim 15, further comprising a base to receive at least part of the liquid medium.

17. The apparatus of claim 15, further comprising a reservoir concealer.

18. The apparatus of claim 15, further comprising a dioramic scene positioned superior to the base.

19. The apparatus of claim 15, further comprising a dioramic scene positioned within the base.

20. The apparatus of claim 15, wherein the at least one device emits both light and sound.

21. The apparatus of claim 20, wherein the at least one device emits lights and sounds simulating a storm.

22. A waterfall-simulating apparatus comprising:

an interior space visible from outside the apparatus and a reservoir adjacent to the interior space;

a liquid medium;

a flowplate comprising at least one liquid input port and at least one liquid output port;

wherein the at least one liquid output port is configured to output at least a portion of the liquid medium from the reservoir into the interior space;

wherein the at least one liquid input port is configured to input at least a portion of the liquid medium from the interior space into the reservoir;

wherein the sizes of the liquid intake port and the liquid output port are such that the amount of time it takes the liquid medium to move from the reservoir to the interior space is at least about double the amount of time it takes the liquid medium to move from the interior space to the reservoir, and wherein the liquid output ports are configured and arranged on the flowplate in such a manner to simulate a river or waterfall within the interior visible space.

23. The apparatus of claim 22, further comprising a base to receive at least part of the liquid medium.

24. The apparatus of claim 22, further comprising a reservoir concealer.

25. The apparatus of claim 22, further comprising a dioramic scene positioned superior to the base.

26. The apparatus of claim 22, further comprising a dioramic scene positioned within the base.

* * * * *